US010794113B2

(12) United States Patent
Tapley

(10) Patent No.: US 10,794,113 B2
(45) Date of Patent: Oct. 6, 2020

(54) COMPACT PRIVACY SCREEN

(71) Applicant: Marketing Displays, Inc., Farmington Hills, MI (US)

(72) Inventor: Troy Ryan Tapley, Wixom, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 285 days.

(21) Appl. No.: 15/848,610

(22) Filed: Dec. 20, 2017

(65) Prior Publication Data

US 2018/0179811 A1 Jun. 28, 2018

Related U.S. Application Data

(60) Provisional application No. 62/437,709, filed on Dec. 22, 2016.

(51) Int. Cl.
*E06B 9/24* (2006.01)
*E05D 3/02* (2006.01)
(Continued)

(52) U.S. Cl.
CPC ..... *E06B 9/24* (2013.01); *A47G 5/00* (2013.01); *E05D 3/02* (2013.01); *E05D 11/1007* (2013.01)

(58) Field of Classification Search
CPC ..... E06B 9/24; E04H 15/005; E04H 15/44; E04H 15/46; E04H 15/48; E01F 9/688; A47G 5/00
See application file for complete search history.

(56) References Cited

U.S. PATENT DOCUMENTS 1,288,518 A * 12/1918 Collier ..... E04H 15/44 135/157
1,509,881 A * 9/1924 Severin ..... E04H 15/48 135/143

(Continued)

FOREIGN PATENT DOCUMENTS

JP 2016-030991 A 3/2016

OTHER PUBLICATIONS

"Gawkstopper", retrieved from https://gawkstopper.com/ (Year: 2019).*

(Continued)

*Primary Examiner* — Katherine W Mitchell
*Assistant Examiner* — Abe Massad
(74) *Attorney, Agent, or Firm* — Harness, Dickey & Pierce, P.L.C.

(57) ABSTRACT

A privacy screen or movable barrier including a plurality of base support members and a curtain. Each of the base support members including a base, a plurality of legs that are pivotably connected to the base, and a post that extends outward from the base. The curtain includes a plurality of frame members and at least one panel connected between the frame members. Each frame member includes a proximal portion configured to mate with the post of a respective base support member, and a distal portion that is hingedly connected to the proximal portion. In a deployed state of the base support members, the legs extend radially outward from the base, and in a non-deployed state of the base support members, the legs extend axially parallel with the post. In a deployed state of the curtain, the distal portion is unfolded relative to the proximal portion, and in a non-deployed state of the curtain, the distal portion is folded relative to the proximal portion.

17 Claims, 9 Drawing Sheets

(51) Int. Cl.
*A47G 5/00* (2006.01)
*E05D 11/10* (2006.01)

(56) References Cited

U.S. PATENT DOCUMENTS 2,571,382 A * 10/1951 Raven ..... G03B 21/58 403/190
4,077,418 A * 3/1978 Cohen ..... E04H 15/48 135/118
4,241,777 A 12/1980 Wenger et al.
4,444,240 A 4/1984 Bannister
4,572,473 A * 2/1986 Seely ..... G09F 7/22 248/160
5,069,238 A * 12/1991 Marks ..... E04H 15/48 135/153
5,340,068 A 8/1994 Sarkisian et al.
5,553,648 A * 9/1996 Goharjou ..... A47G 5/00 135/127
5,875,597 A 3/1999 Gingrich et al.
6,182,740 B1 * 2/2001 Pfaff ..... A47G 5/00 160/135
6,718,669 B1 * 4/2004 Hayes ..... G09F 15/0062 40/603
6,755,381 B1 * 6/2004 Levin ..... F16M 11/16 248/163.1
7,231,954 B2 * 6/2007 Green ..... E01F 13/022 135/114
8,973,645 B1 * 3/2015 Cannova ..... E01F 7/00 160/351
9,051,751 B2 * 6/2015 Ogilvie ..... E04H 15/005
2006/0060310 A1 * 3/2006 Haugen ..... E04H 12/2215 160/135
2010/0288450 A1 * 11/2010 Bruck ..... F16P 1/02 160/238
2016/0298328 A1 * 10/2016 Williams ..... E04H 15/44

OTHER PUBLICATIONS

"SRN-1000", retreived from https://srn1000.com/ (Year: 2019).*
Written Opinion and International Search Report for PCT/US2017/067977 dated Apr. 5, 2018.
"Gawkstopper," retrieved from https://gawkstooper.com/ (Year: 2019).
"SRN-1000," retrieved from https://www.srn1000.com/ (Year: 2019).
"JiffyWall," retrieved from http://www.jiffywall.com/ (Year: 2018).

* cited by examiner

COMPACT PRIVACY SCREEN

CROSS-REFERENCE TO RELATED APPLICATIONS

This application claims the benefit of U.S. Provisional Application No. 62/437,709 filed on Dec. 22, 2016. The entire disclosure of the above application is incorporated herein by reference.

FIELD

The present disclosure relates to a portable privacy screen or barrier.

BACKGROUND

This section provides background information related to the present disclosure which is not necessarily prior art.

It is well known by safety officials and police officers concerned with safety and with maintaining the flow of motor vehicle traffic that many traffic jams and secondary accidents are attributable to the slowdown and jamming of traffic at accident sites. Whenever an accident occurs, it not only slows traffic in the traffic lane where the accident occurs, but also results in the slowing of traffic in the opposite lane as a result of motorists slowing to look at the site of the accident. There is a need, therefore, for a portable screen of a size and construction that is capable of being carried and erected by a single individual at the site of an accident.

SUMMARY

This section provides a general summary of the disclosure, and is not a comprehensive disclosure of its full scope or all of its features.

The present disclosure provides a privacy screen or movable barrier including a plurality of base support members and a curtain. Each of the base support members includes a base, a plurality of legs that are pivotably connected to the base, and a post that extends upward from the base. The curtain includes a plurality of frame members and at least one panel connected between the frame members. Each frame member includes a proximal portion configured to mate with the post of a respective base support member, and a distal portion that is hingedly connected to the proximal portion. In a deployed state of a base support member, the legs extend radially outward from the base, and in a non-deployed state of the base support member, the legs extend axially parallel with the post. In a deployed state of the curtain, the distal portion is unfolded relative to the proximal portion, and in a non-deployed state of the curtain, the distal portion is folded relative to the proximal portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
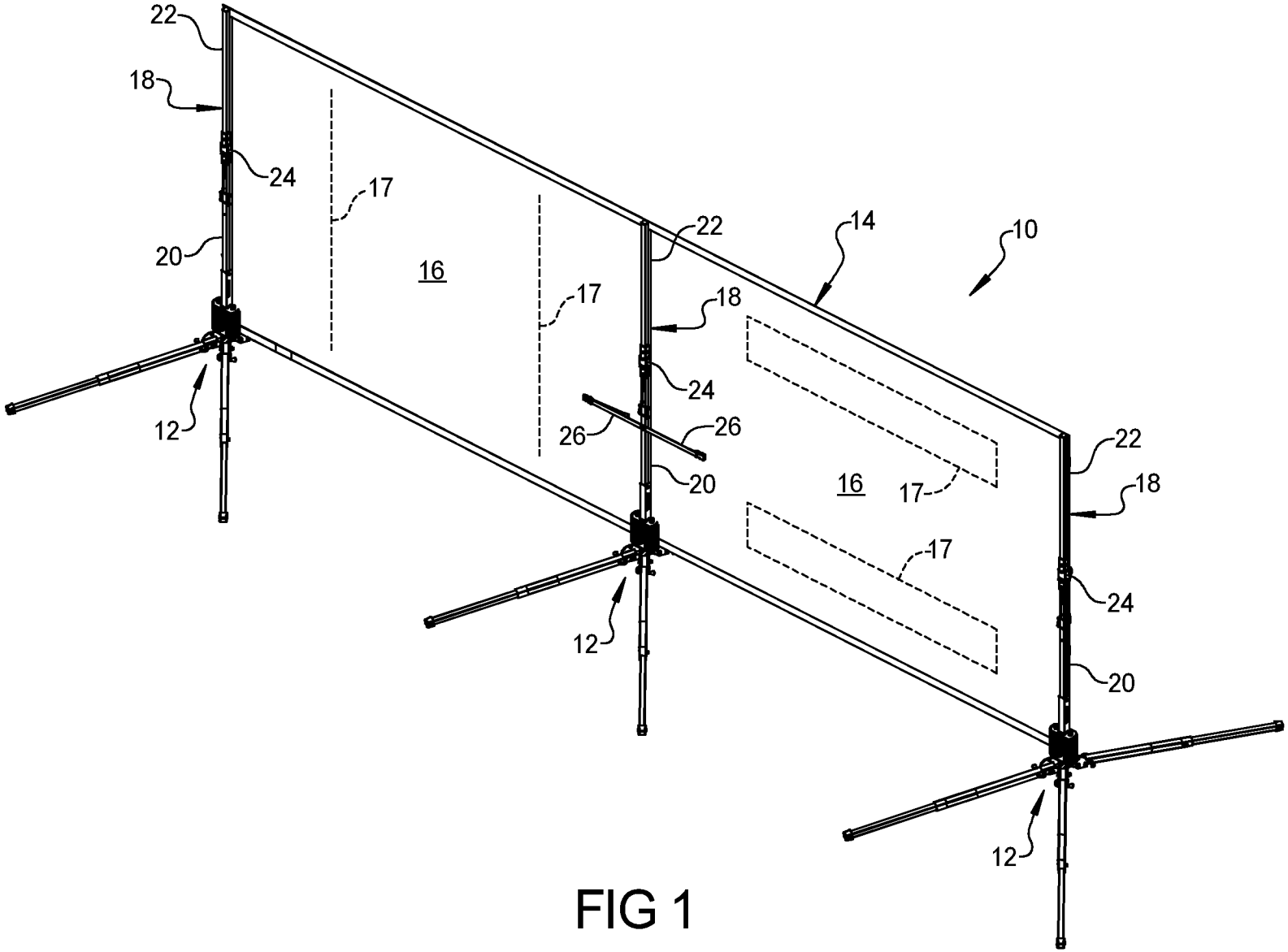
FIG. 1 is a perspective view of a privacy screen according to a principle of the present disclosure in a deployed configuration.

FIG. 1 illustrates a privacy screen 10 according to a principle of the present disclosure, in a deployed configuration. Privacy screen 10 is a portable device that may be deployed, when needed. For example, privacy screen 10 may be used at the scene of an accident to shield people from seeing the result of the accident. Alternatively, privacy screen 10 may be used as a barrier to prevent ingress and egress from a certain location (e.g., at a construction site). Regardless, privacy screen 10 may be used in any situation an item or location is desired to be shielded from view, or any situation that requires a portable, temporary barrier.

Figure 2:
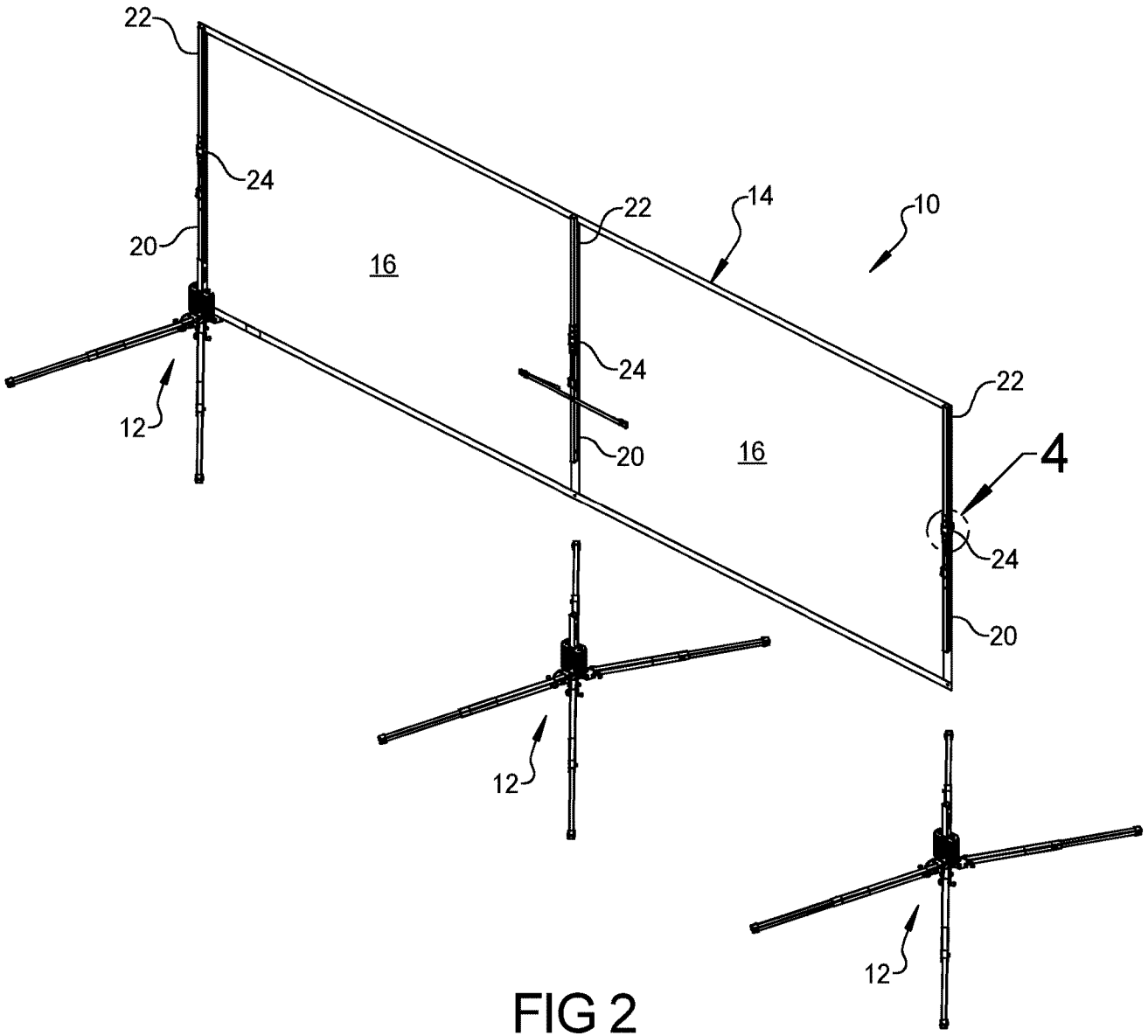
FIG. 2 is an exploded perspective view of the privacy screen illustrated in FIG. 1.

As best shown in FIGS. 1 and 2, privacy screen 10 includes a plurality of base support members 12 that each cooperate to support a curtain 14. In the illustrated embodiment, curtain 14 includes a pair of panels 16. It should be understood, however, that a single panel 16 or additional panels 16 are contemplated. Regardless, panels 16 may be formed of materials such as cloth, mesh, or synthetic materials such as nylon. Panels 16 may also include slits or cut-outs 17 formed therein that allow for viewing through the privacy screen 10, or for allowing wind to pass therethrough so as to assist in preventing privacy screen 10 from being toppled over. Although cut-outs 17 are illustrated as being rectangular or slit-shaped, any shape (e.g., circular, oval, triangular, square, moon-shaped, and the like) can be used, without limitation.

Panels 16 may have a height in the range of four to ten feet, and a width in the range of four to twelve feet. One skilled in the art, however, will readily acknowledge and appreciate that panels 16 may be dimensioned in any manner desired. Further, panels 16 may be opaque, transparent, or translucent, and may also include a message such as "CAUTION" or some other type of message. In this regard, if privacy screen 10 is to be used in a shielding manner, panels 16 should preferably be opaque to prevent viewing of the item or location that is desired to be shielded from view.

Alternatively, if privacy screen 10 is to be used as a barrier, panels 16 do not necessarily need to be opaque, and a transparent or translucent panel 16 may be used to allow viewing of the item or location on the other side of the barrier.

Curtain 14 includes frame members 18 that are configured to support panels 16. Frame members 18 each include a proximal portion 20 configured to attach to support members 12, and a distal portion 22. A collective length of proximal portion 20 and distal portion 22 may be in the range of four to ten feet, with proximal portion 20 and distal portion 22 having equal lengths or differing lengths. One skilled in the art, however, will readily acknowledge and appreciate that frame members 18 may be dimensioned in any manner desired. Although not required, a hinge 24 can connect proximal portion 20 and distal portion 22, which allows curtain 14 to be folded and rolled when privacy screen 10 is in a non-deployed state.

Frame members 18 are tubular in nature and formed of a material such as a metal (e.g., aluminum or steel) or a rigid polymeric material (e.g., polystyrene, polyamide, etc.). The rigid polymeric material may include reinforcing fibers or glass filler, if desired. Panels 16 may be attached to frame members 18 using rivets (not shown) or some other type of fastener such that panels 16 can be permanently attached. Alternatively, panels 16 may include a sleeve (not shown) configured for receipt of frame members 18 therein such that panels 16 can be removable from frame members 18. Regardless, panels 16 may be attached to frame members 18 in any manner known to one skilled in the art. A pair of straps 26 may be attached to frame members 18, which assist securing curtain 14 in a folded or rolled state.

Although not required by the present disclosure, frame members 18 can include one or more sub frame members (not shown) that extend transversely relative to frame members 18, which assist in further supporting panels 16 relative to frame members 18. In this regard, the sub frame members may extend outward from frame member 18 in a manner similar to which straps 26 are illustrated in FIG. 1. Sub frame members may be hingedly connected to frame members 18 or, alternatively, may be connected to support members 12.

Figure 3:
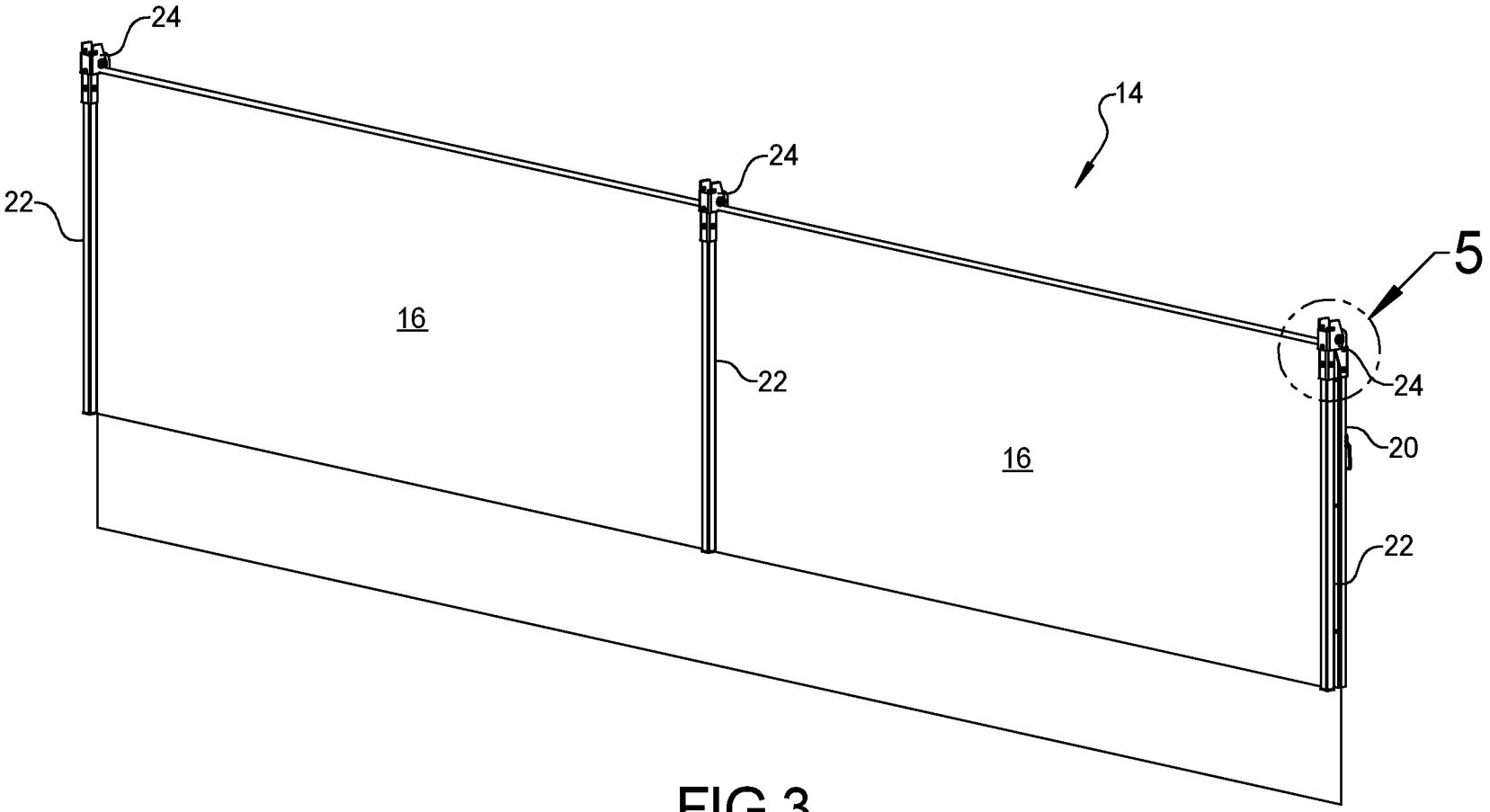
FIG. 3 is a perspective view of a screen of the privacy screen in a partially unfolded configuration and detached from a plurality of base support members that support the screen, according to a principle of the present disclosure.
Figure 4:
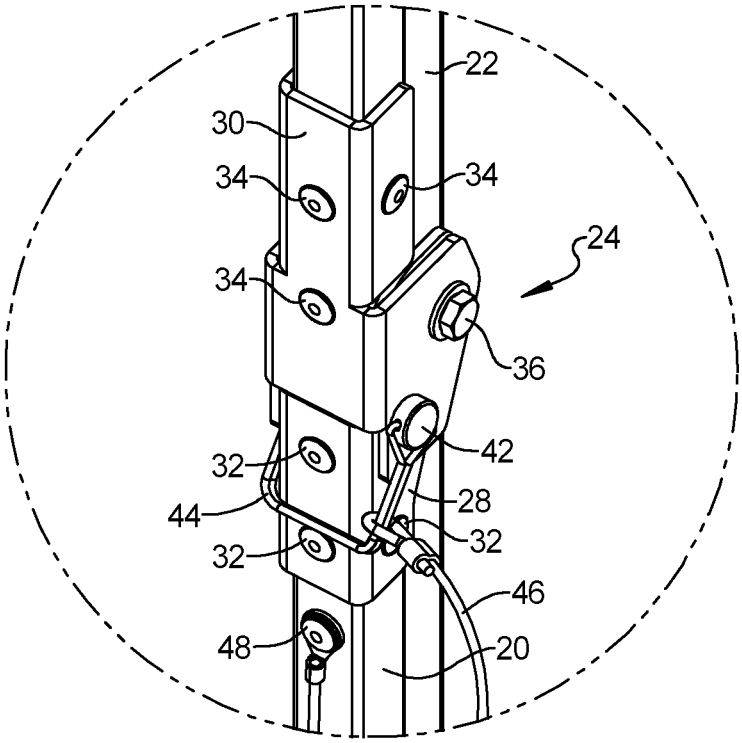
FIG. 4 is a partial perspective view of frame member including a hinge, in a deployed configuration.
Figure 5:
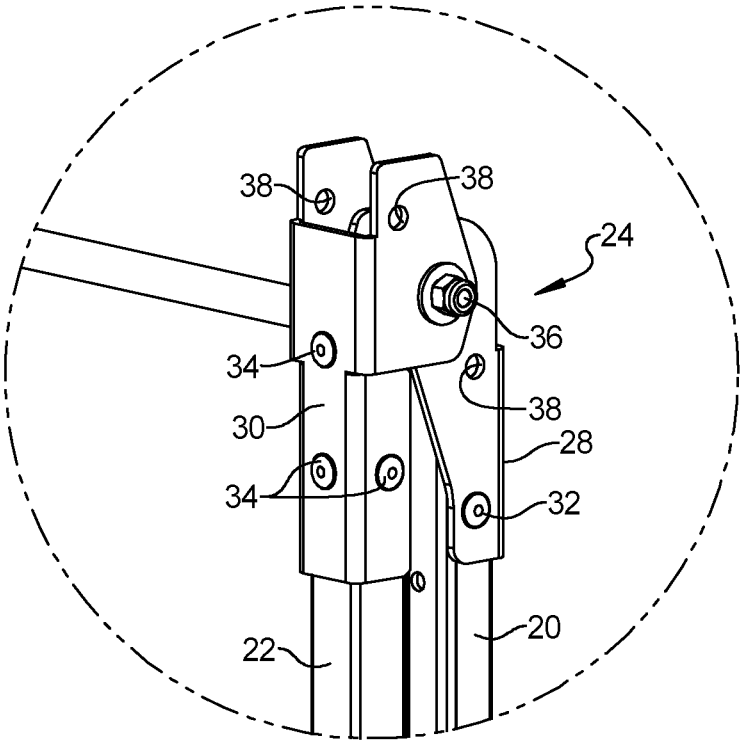
FIG. 5 is a partial perspective view of the frame member including the hinge, in a non-deployed configuration.

As best shown in FIGS. 3-5, hinges 24 each include a proximal bracket 28 and a distal bracket 30. Proximal bracket 28 is configured for receipt of proximal portion 20 therein, while distal bracket 30 is configured to receipt of distal portion 22 therein. Proximal bracket 28 may be formed of materials such as aluminum or steel, and is connected to proximal portion 20 by rivets 32 or some other type of fastener such as a screw. Similarly, distal bracket 30 is also formed of a material such as aluminum or steel, and is connected to distal portion 22 by rivets 34 or some other type of fastener such as a screw. Proximal bracket 28 and distal bracket 30 are rotatably connected to each other via a bolt 36 that acts as an axis of rotation.

To secure curtain 14 in a deployed state (FIG. 4), proximal bracket 28 and distal bracket 30 of hinge 24 each include apertures 38 that align when curtain 14 is in the deployed state. Apertures 38 are configured for receipt of a locking device 40. Locking device 40 includes a pin 42 that extends through apertures 38 to secure proximal portion 20 relative to distal portion 22 of frame members 18. In addition, locking device 40 includes a U-shaped member 44 which may pivot to abut proximal bracket 28 or proximal portion 20 to further prevent disengagement of locking device 40 from hinge 24 when curtain 14 is in the deployed state. When curtain 14 is to be in the non-deployed state, locking device 40 may be removed from hinge 24 to allow distal bracket 30 and distal portion 22 to rotate relative to proximal bracket 28 and proximal portion 20. To ensure that locking device 40 is not lost during non-use of privacy screen, locking device 40 can optionally include a tether 46 that is attached to proximal portion 20 by a rivet 48 or some other fastener such as a screw. After folding distal portion 22 towards proximal portion 20 (FIG. 3), curtain 14 may be rolled up, and the straps 26 secured to maintain the rolled up state. It should be understood that if curtain 14 includes sub frame members, the sub frame members should be folded to be parallel with proximal portion 20 so as not to inhibit rolling up of curtain 14.

Figure 6:
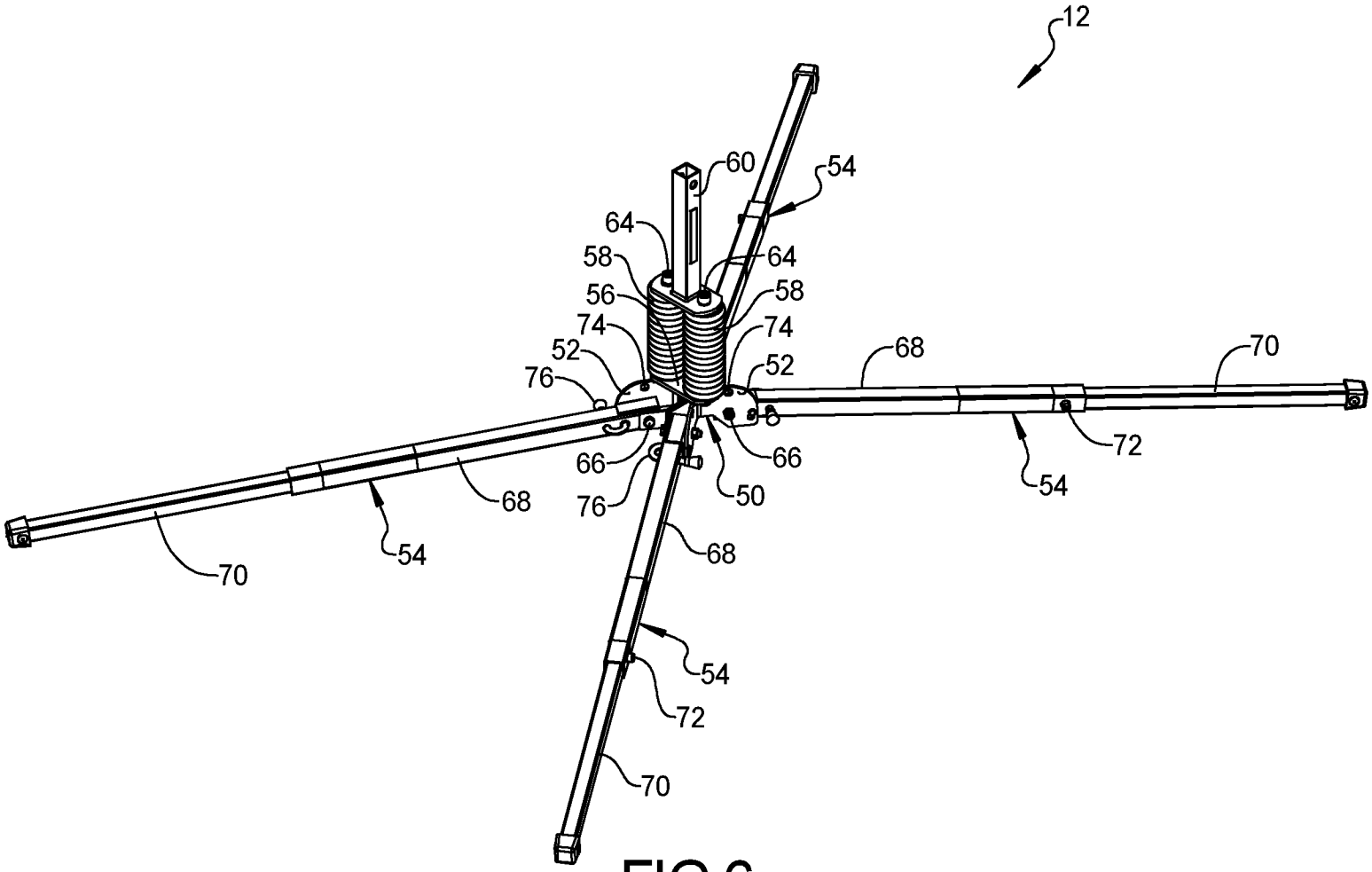
FIG. 6 is a perspective view of a base support member of the privacy screen in a deployed configuration.
Figure 7:
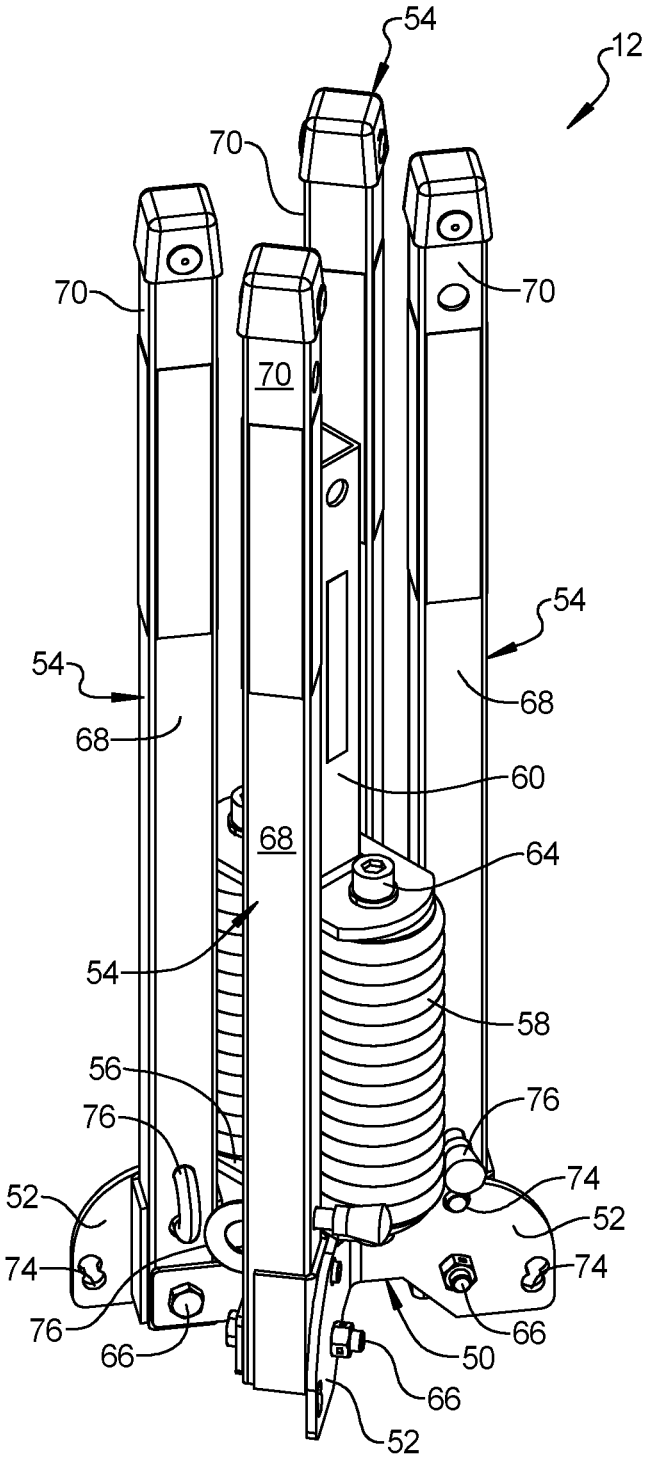
FIG. 7 is a perspective view of the base of the privacy screen in a non-deployed configuration.

Now referring to FIGS. 6 and 7, base support members 12 will be described. Base support members 12 are similar to those described in U.S. Pat. No. 5,340,068 assigned to assignee of the present disclosure, and sold in conjunction with various products under the tradename WINDMASTER®, which is incorporated herein by reference in its entirety. Base support members 12 each include butterfly-shaped base 50 including a plurality of base brackets or lobes 52, that each define a mounting surface for a respective leg 54 of base member 12. Further, butterfly-shaped base 50 includes a first spring bracket 56 for supporting a pair of springs 58 and an upright support member or post 60 connected to a second spring bracket 62 such that post 60 is secured to springs 58.

Post 60 is a tubular member configured to be received within proximal portion 20 of frame member 18 of curtain 14. Springs 58 allow curtain 14 to move relative to base members 12 without toppling over in windy conditions, or when curtain 14 is contacted by some other force. Butterfly-shaped base 50 including lobes 52, spring brackets 56, and springs 58 may be formed of steel or some other type of type of metal material. Springs 58 may be attached between spring brackets 56 by welding, brazing, or by fasteners 64. Lower spring bracket 56 may be attached to lobes 52 by welding, brazing, or some other method.

Legs 54 may be pivotably connected to lobes 52 using a bolt 66, screw, or some other type of fastening device that allows legs 54 to pivot relative to lobe 52. Legs 54 are tubular members including a first portion 68 pivotably connected to lobe 52, and a second portion 70 that is configured to move telescopically relative to first portion 68. With such a configuration, legs 54 can extend outward relative to base 50 to an extent that base support members 12 assist in preventing privacy screen 10 from toppling over during use. To secure second portion 70 in an extended condition, a spring-loaded detent pin 72 may be used. When base support members 12 are to be in a non-deployed state, second portion 70 may be telescoped into first portion 68 by depressing or pulling spring-loaded detent pins 72, and then legs 54 may be rotated upward to be axially parallel with post 60. To lock legs 54 in either the deployed or non-deployed states, each lobe 52 includes apertures 74 for receipt of a spring-loaded pin 76 attached to first portion 68. An extended length of legs 54 can range between two to four feet, while a non-extended length of legs 54 (i.e., second portion 70 telescoped into first portion) can be in the range of one to two feet.

Base support members 12 and curtain 14, when each are in non-deployed states, may be separately stored in a bag or pouch (not shown). In the non-deployed states, base support members 12 and curtain 14 are designed to be easily stored in, for example, the trunk of a vehicle. When privacy screen 10 is to be used as a barrier or shield, base support members 12 and curtain 14 are each removed from their respective bag or pouch. When removed from the bag or pouch, base support members 12 are in the non-deployed state (FIG. 7) and are then manipulated into the deployed state (FIG. 6). In this regard, pin 76 is unlocked and legs 54 are moved from the axially parallel orientation (FIG. 7) to the extended position (FIG. 6), and, if desired, second portion 70 can be telescoped outward from first portion 68 until spring-loaded pin 72 is engaged.

When curtain 14 is removed from the bag or pouch, the straps 26 are unfastened and curtain 14 is unrolled. Distal portions 22 may then be unfolded relative to proximal portions 20. Distal portion 22 is then locked in the unfolded position by using locking devices 40. Proximal portions 20 are then mated with posts 60, and base support members 12 are spaced apart at the desired locations for proper placement of the privacy screen 10.

Although privacy screen 10 is illustrated in an upright and fully expanded configuration in FIG. 1, it should be understood that the present disclosure should not be limited thereto. In this regard, it should be understood that hinge members 24 may be located in partially unfolded states such that distal portion 22 may be angled (i.e., non-axially aligned) relative to proximal portion 20 (e.g., at 45 degrees or any other angle). This can be achieved by adding additional apertures 38 at different locations on hinge 24 for receipt of locking device 40.

Figure 8:
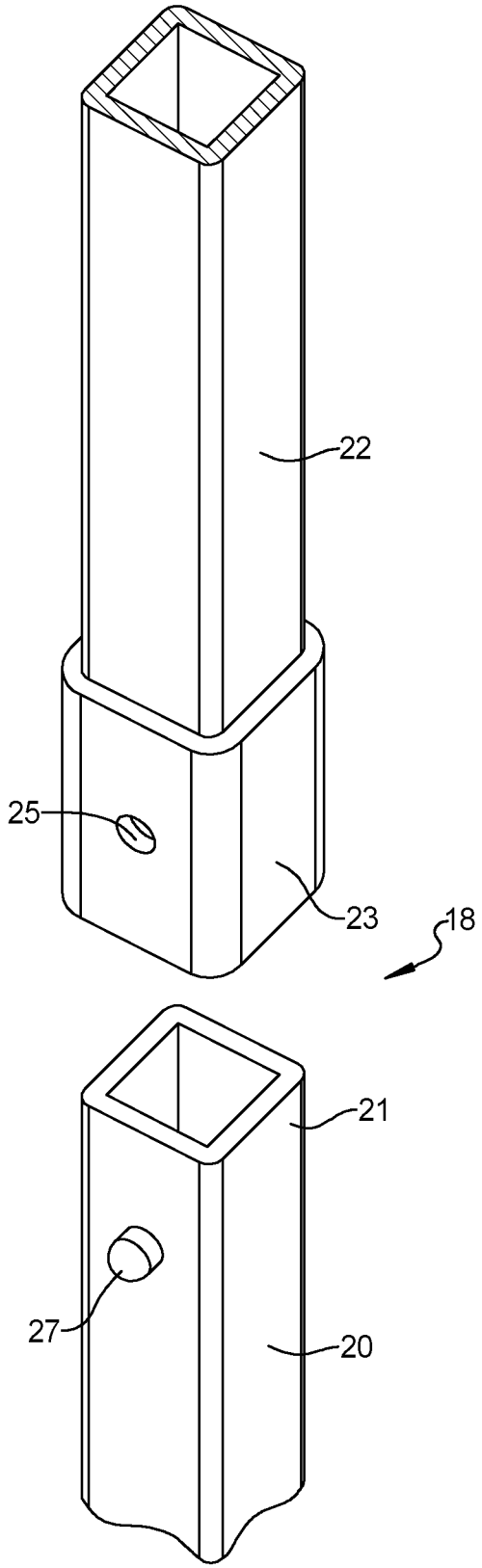
FIG. 8 is a partial perspective view of another frame member according to a principle of the present disclosure.

Now referring to FIG. 8, it can be seen that support members 18 are not necessarily connected to each other using hinge 24. In contrast, proximal portion 20 and distal portion 22 can be separate members that have a swaged relationship where distal portion 22 includes a swaged end 23 that receives a portion 21 of proximal portion 20 therein. Swaged end 23 can be securely attached to portion 21 by an interference fit, or swaged end 23 can include an aperture 25 for receipt of a spring-loaded protrusion 27 formed on portion 21 of proximal portion 20. Alternatively, portion 21 can have a projection or detent (not shown) that mates with an interior receiving surface (not shown) formed within the interior of the swaged end 23.

Figure 9:
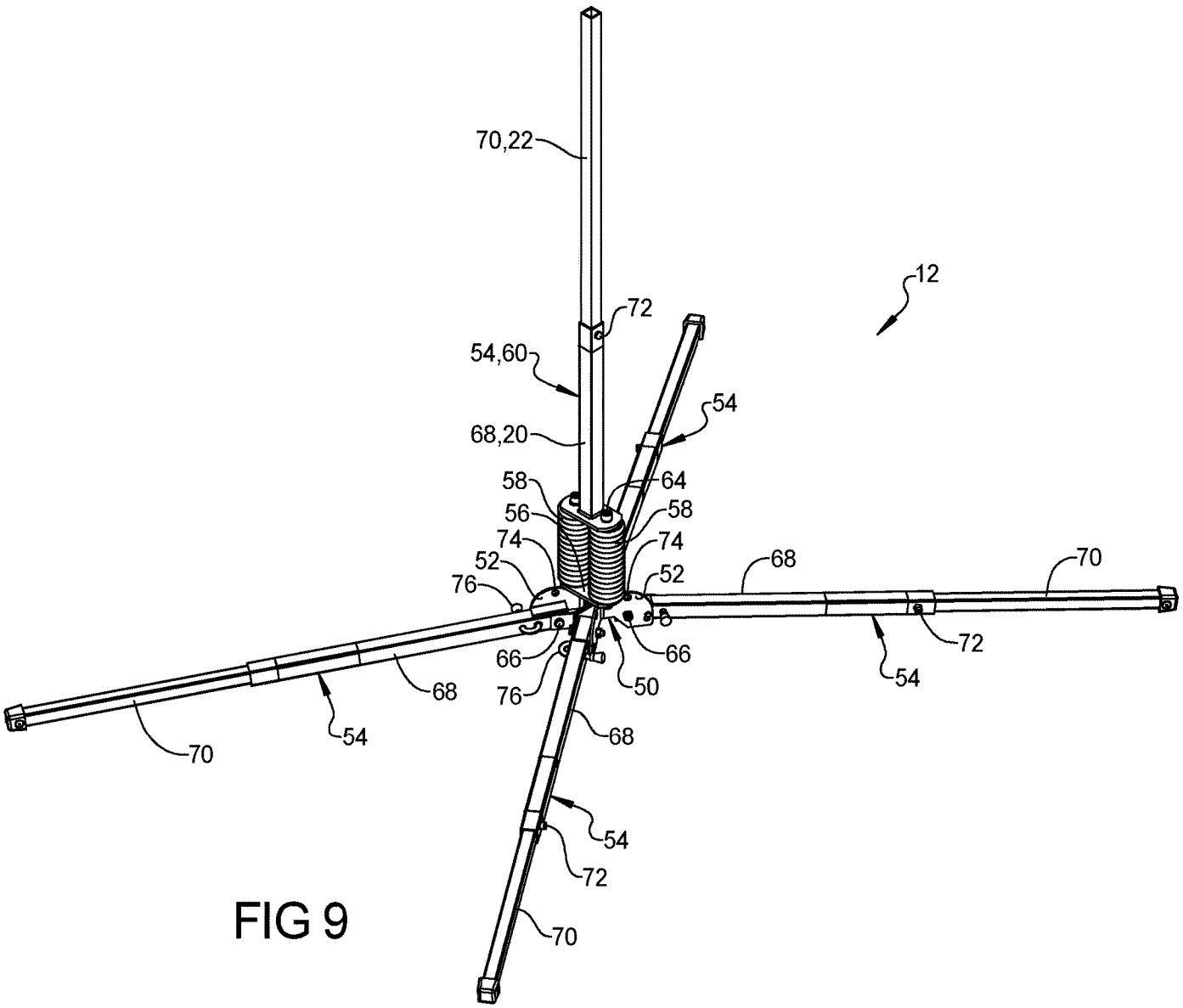
FIG. 9 is a perspective view of another base support member of the privacy screen in a deployed configuration.

Yet another alternative configuration includes support members 18 being permanently connected to base support members 12. In this regard, as best shown in FIG. 9, post 60 can be replaced by another telescoping leg 54 such that first portion 68 of leg 54 can function as proximal portion 20 and second portion 70 of leg 54 can function as distal portion 22. To deploy privacy screen 10 using such a configuration, the second portion 70 (i.e., distal portion) can be telescopically extended from first portion 68 (i.e., proximal portion) and locked in place, and then curtain 14 can be located over each of the second portion 70 (i.e., distal portion) and the first portion 68 (i.e., proximal portion).

Figure 10:
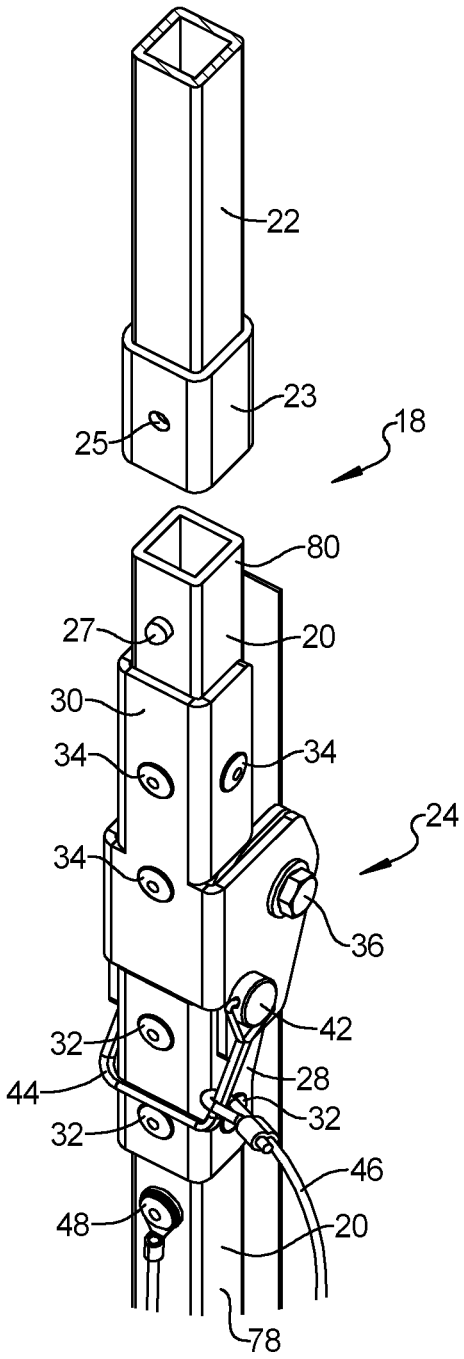
FIG. 10 is a partial perspective view of another frame member according to a principle of the present disclosure.

Yet another alternative configuration, as can be seen in FIG. 10, includes a structure where proximal portion 20 includes hinge 24 located between opposing ends 78 and 80 thereof. Distal portion 22 can then include a swaged end 23 that mates with end 80. Swaged end 23 can include an aperture 25 for receipt of a spring-loaded protrusion 27 formed on end 80 of proximal portion 20. Alternatively, end 80 can have a projection or detent (not shown) that mates with an interior receiving surface (not shown) formed within the interior of the swaged end 23. With such a configuration, hinge members 24 may be located in partially unfolded states such that distal portion 22 may be angled (i.e., non-axially aligned) relative to proximal portion 20 (e.g., at 45 degrees or any other angle).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A privacy screen or movable barrier positionable between a folded state and a deployed state, the privacy screen or movable barrier comprising:

a plurality of base support members; and a curtain including a plurality of frame members and at least one panel connected between the frame members, each frame member including a proximal frame member configured to mate with a respective base support member, and a distal frame member that is configured to mate with the proximal frame member, wherein the proximal frame member includes a first section and an opposite second section that are connected to each other by a hinge, the first section and the second section being configured to be telescopically positioned within the hinge and secured to the hinge with at least one fastener;

the distal frame member includes a swaged end configured to mate with the second section of the proximal frame member, wherein, in the folded state, the curtain is folded and separate and apart from the plurality of base support members; and wherein, in a deployed state, the curtain is unfolded, the first sections of the proximal frame members are mated to respective base support members, and the distal frame members are mated to respective second sections of the proximal frame members.

2. The privacy screen or movable barrier according to claim 1, wherein each of the base support members include a base, a plurality of legs that are pivotably connected to the base, and a post that extends upward from the base; and in the deployed state, the first sections of the proximal frame members are connected to a respective post of a respective base support member.

3. The privacy screen or movable barrier according to claim 1, wherein, in the deployed state, the distal frame member is axially aligned with the proximal portion.

4. The privacy screen or movable barrier according to claim 1, wherein, in the deployed state, the second section of the frame member and the distal frame member are non-axially aligned relative to the first section of the proximal frame member.

5. The privacy screen or movable barrier according to claim 2, wherein each base support member includes a spring connected between the base and the post.

6. The privacy screen or movable barrier according to claim 1, wherein the hinge includes apertures formed therein for receipt of a locking device.

7. The privacy screen or movable barrier according to claim 1, wherein the panel is one of opaque, transparent, or translucent.

8. The privacy screen or movable barrier according to claim 1, wherein the panels include a slit or cut-out.

9. The privacy screen or movable barrier according to claim 1, wherein the curtain is either fixed to the frame members or removably attached to the frame members.

10. A privacy screen or movable barrier positionable between a folded state and a deployed state, the privacy screen or movable barrier comprising:

a plurality of base support members, each of the base support members including a base, a plurality of legs that are pivotably connected to the base, a post that extends upward from the base, and at least one spring connected between the base and the post that allows the post to move relative to the base; and a curtain including a plurality of frame members and at least one panel connected between the frame members, each frame member including a proximal frame member configured to mate with a respective post of the base support member, and a distal frame member that is configured to mate with the proximal frame member, wherein the proximal frame member includes a first section and an opposite second section that are connected to each other by a hinge, the first section and the second section being configured to be telescopically positioned within the hinge and secured to the hinge with at least one fastener;

the first section is configured to mate with the respective post of the base support member, the distal frame member includes a swaged end configured to mate with the second section of the proximal frame member, wherein, in the folded state, the curtain is folded and separate and apart from the plurality of base support members; and wherein, in a deployed state, the curtain is unfolded, the first sections of the proximal frame members are mated with the respective post of the base support members, and the distal frame members are mated with respective second sections of the proximal frame members.

11. The privacy screen or movable barrier according to claim 10, wherein, in the deployed state, the distal frame member is axially aligned with the proximal frame member.

12. The privacy screen or movable barrier according to claim 10, wherein, in the deployed state, the distal frame member and second section of the proximal frame member are non-axially aligned relative to the first section of the proximal frame member.

13. The privacy screen or movable barrier according to claim 10, wherein the hinge includes apertures formed therein for receipt of a locking device.

14. The privacy screen or movable barrier according to claim 10, wherein the panel is one of opaque, transparent, or translucent.

15. The privacy screen or movable barrier according to claim 10, wherein the panels include a slit or cut-out.

16. The privacy screen or movable barrier according to claim 10, wherein the curtain is either fixed to the frame members or removably attached to the frame members.

17. The privacy screen or movable barrier according to claim 10, wherein the base includes a plurality of lobes, each of the legs being attached to a respective lobe.

* * * * *